United States Patent [19]

Piper

[11] Patent Number: 4,504,696

[45] Date of Patent: Mar. 12, 1985

[54] TUBULAR WOVEN CONTROLLED IMPEDANCE CABLE

[75] Inventor: Douglas E. Piper, Greenville, S.C.

[73] Assignee: Woven Electronics Corporation, Mauldin, S.C.

[21] Appl. No.: 481,755

[22] Filed: Apr. 4, 1983

[51] Int. Cl.[3] ..... H01B 7/04; H01B 13/00

[52] U.S. Cl. ..... 174/32; 156/47; 174/117 M

[58] Field of Search ..... 174/32, 34, 115, 117 M, 174/113 AS, 117 AS; 87/9; 156/47

[56] References Cited

U.S. PATENT DOCUMENTS

| | | | |
|---|---|---|---|
| 2,740,316 | 4/1956 | Crossley et al. | 87/9 |
| 3,634,782 | 1/1972 | Marshall | 174/117 F |
| 3,815,054 | 6/1974 | McClure et al. | 174/113 R |
| 4,143,236 | 3/1979 | Ross et al. | 174/117 F |
| 4,158,104 | 6/1979 | Ross | 174/117 M |
| 4,229,615 | 10/1980 | Orr, Jr. et al. | 174/117 M |
| 4,460,803 | 7/1984 | Piper | 174/117 M |
| 4,463,323 | 7/1984 | Piper | 174/117 M |

FOREIGN PATENT DOCUMENTS

| | | | |
|---|---|---|---|
| 840714 | 4/1952 | Fed. Rep. of Germany | 174/34 |
| 1260636 | 4/1961 | France | 174/113 AS |

OTHER PUBLICATIONS

Kolias, John T.; "How FEP and Flame Retardant PE Flat Cable Insulations Compare"; Insulation/Circuits; Aug. 73; pp. 23–24.

*Primary Examiner*—A. T. Grimley
*Assistant Examiner*—Morris H. Nimmo
*Attorney, Agent, or Firm*—Cort Flint

[57] ABSTRACT

A woven electrical transmission cable is disclosed having a controlled impedance and reduced signal interference characteristic in which the density of the signal conductors may be increased without widening the configuration of the cable. The cable (A, F, K) is woven in a tubular configuration wherein the signal conductors (10, 30, 34) are arranged and woven about the periphery of the cable with a vertical spacing component between the conductors. The signal conductors are arranged with ground conductors (12, 32, 36) on each side thereof in the form of clusters (D, E, G, H) in strata about the periphery of the cable. In a preferred form the cable (F, K) is woven in a flattened oval configuration wherein the clusters of conductors are arranged in spaced layers which are generally parallel. In practice, noisy lines and quiet lines may be placed in opposed layers for maximum reduction of signal interference.

8 Claims, 6 Drawing Figures

TUBULAR WOVEN CONTROLLED IMPEDANCE CABLE

BACKGROUND OF THE INVENTION

The invention relates to high frequency woven electrical transmission cables used in high speed electronic equipment such as sophisticated telecommunication and computer systems wherein high speed switching circuitry is employed. In these applications the reliability and accuracy of the transmitted signals necessitates considerable attention and critical to achieving this is the requirement that the impedance of the cable be matched with the load of the input in order to transmit a representative accurate signal at the output.

Another source of signal error in this type cable is unwanted electrical noise picked up between adjacent conductors during the transmission of signals. In high speed logic circuits discrete signals of either a high or low value are normally transmitted for triggering the logic circuits. An error produced by unwanted electrical noise can produce false triggering of the logic circuits.

Isolating the signal wires from each other and controlling the impedance of the cable are problems to which considerable attention need be given in order to accurately transmit high frequency electrical signals in high technology electronic systems.

Various types of flat controlled impedance cables have been proposed. It has been proposed in U.S. Pat. No. 4,143,236 to weave a high frequency flat controlled impedance cable in such a manner that adjacent signals are isolated by pairs of ground wires with the location and configuration of the signal and ground wires fixed in the cable by means of the weave. In this manner, a very precisely controlled impedance cable can be provided. Other attempts to provide a controlled impedance cable which accurately transmits high frequency signals have included laminated cables such as disclosed in U.S. Pat. No. 3,634,782.

The use of an increasing number of pins in the terminal connectors in the electronic systems has required that more and more signal conductors be placed in the cable resulting in wider and wider flat cable structures. However, when the woven cable becomes too wide, it becomes difficult to route in the chassis of the equipment. In accordance with the present invention, up to twice as many conductors may be provided in the same width as the flat cables before. Where increased pins are not used, the cable may be made half the width as before without any increase in signal interference between adjacent conductors.

U.S. Pat. No. 3,815,054 discloses a low impedance, high frequency line wherein a plurality of insulated electrical wires are peripherally clustered in a ring about an idler center in a non-woven construction which is generally unrelated to the present invention.

SUMMARY OF THE INVENTION

The above objectives are accomplished according to the present invention by providing a continuously woven cable in which the signal conductors are laterally spaced and arranged in strata defining a generally tubular construction in which the signal conductors are arranged around the periphery of the cable having a vertical component of displacement from one another to isolate the signal conductors from one another which are laterally isolated by exclusive ground wire pairs on either side of the signal conductors. The tubular configuration may be made generally round or oval in cross-section for increased wire densities. The signal conductors have an undulating configuration in each strata which provides a non-parallel relationship between the corresponding conductors of opposing strata rendering virtually nil any cross-talk therebetween. Since there is no significant cross-talk between strata, a noisy pin can be located on the top strata and a quiet pin on the bottom for increased protection.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A woven tubular controlled impedance electrical transmission cable (FIGS. 1 and 2) is disclosed as comprising a number of warp elements which include a plurality of signal conductors S extending in a warp direction and a ground conductor g extending in the warp direction on each side of each signal conductor defining a cluster of warp conductor elements. A continuous weft element W is woven with the warp elements to define a tubular woven cable having an open interior with the signal conductors arranged around an open periphery of the cable to provide a vertical component of spacing between each of the signal conductors.

Ground wires g isolate next adjacent signal wires from one another laterally while the vertical displacement isolates the signal conductors vertically from one another.

The signal conductors S are woven with the weft element W in an undulating configuration along the length of the cable. The vertically spaced signal conductors undulate with respect to one another to provide a non-parallel relationship between the signal conductors reducing the signal interference therebetween. The weft element is woven continuously through the clusters of warp conductors to provide continuously woven tubular woven fabric and cable around the entire periphery of the cable. The signal conductors are isolated laterally and vertically from one another. Effective isolation from signal interference and a controlled impedance cable characteristic are provided.

The signal conductors S and ground conductors g are arranged in clusters D around the periphery. More specifically, referring to the schematic representation of FIG. 3, a signal conductor 10 and exclusive ground wire pair 12 are contained in each cluster D. Clusters containing signals 10*a* and 10*d* are generally opposite each other as viewing the ring-like cable periphery as can best be seen in FIG. 3. Likewise, there are clusters containing signal conductors 10*b*, 10*e* and 10*c*, 10*f* generally opposite each other. This allows maximum separation of the signals and even when the cable configuration is somewhat deformed, adequate separation between all of the signals affords effective reduction in signal interference and cross-talk.

The cable structure may take other forms of configuration and for this purpose, the arrangement and spacing of the conductors may be described in terms of strata, meaning a series of spaced layers consisting of warp conductor elements. The layers may be defined by warp conductors in a common plane or by less well-defined layers. The importance being that there is some degree of vertical displacement between the signal conductors of the layers.

Figure 1:
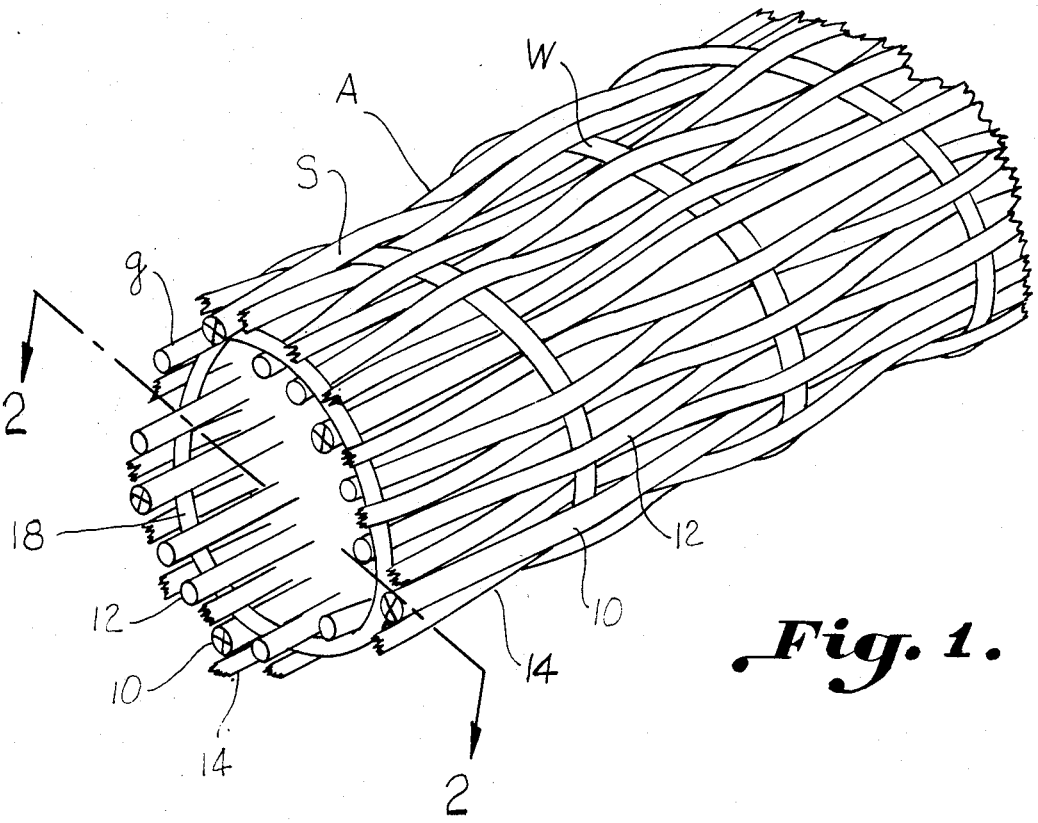
FIG. 1 is a perspective view of a tubular woven controlled impedance cable having a generally round configuration constructed according to the present invention.
Figure 2:
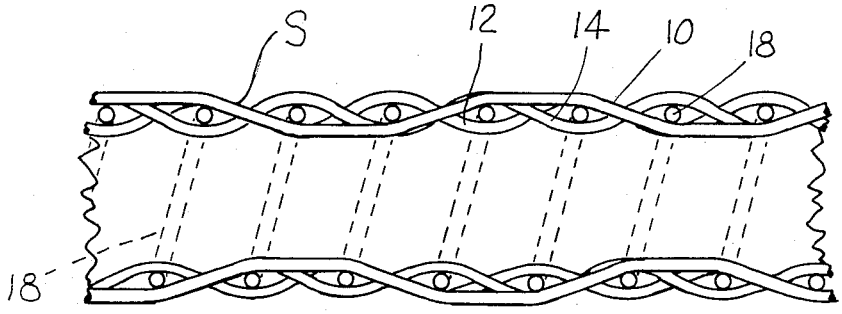
FIG. 2 is a sectional view taken along line 2—2 of FIG. 1.
Figure 3:
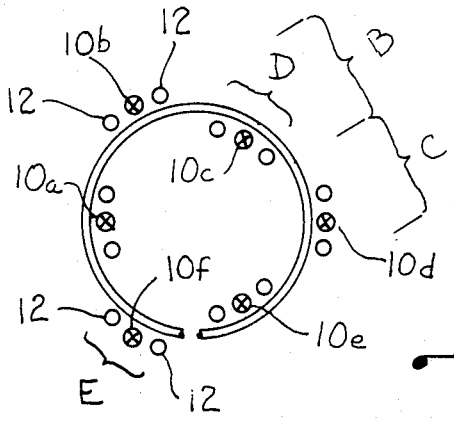
FIG. 3 is a schematic diagram illustrating the geometrical configuration of the conductor and ground wires of a tubular woven controlled impedance cable constructed in accordance with the present invention as taken through a section of FIG. 1.

The woven tubular cable of FIG. 1 can be described as including a first warp strata B (FIG. 3). There are a plurality of warp elements in strata B which include a number of the warp conductor elements 10*a*, 10*b*, 10*c* and ground wires 12 arranged in clusters D. Warp yarns 14 are woven in the cable between conductors and between adjacent clusters as required to fix the spacing between the centers of the signals and hence to fix and control the cable impedance characteristic. The warp elements which are signal conductors are denoted by an X inside the circle. For purposes of clarity, the warp yarns have been omitted from FIG. 3.

A second warp strata C includes a plurality of warp elements which include signal conductors 10*d*, 10*e*, 10*f* extending in the warp direction on each side of the signal conductor. Each signal conductor and adjacent ground wires 12 thus define a cluster E in the second strata.

As thus arranged, strata B includes signals 10*a* and 10*c* arranged in a common plane and layer. Signal 10*b* lies in a layer above that of signals 10*a*, 10*c*. Singals 10*d*, 10*f* of strata C lie in a common plane spaced from that of 10*a*, 10*b*, and 10*c*. Signal 10*e* likewise lies in a separated layer or plane. All signals thus have a vertical component of displacement from one another.

The ground wires 12 isolate the next adjacent signal wire from each other laterally while the vertical displacement of the signal conductors in opposing strata isolates the signal conductors vertically from one another.

The woven construction is completed by a continuous weft element 18 which weaves through both strata. The weft element weaves through the first strata to form a first upper woven cable structure corresponding to strata B. The weft element 18 is woven with the warp elements of the second layer to form a second lower woven cable structure corresponding to strata C.

The signal conductors 10 undulate along the length of the upper and lower cable structure. The cable structure is preferably constructed as illustrated in U.S. Pat. No. 4,143,236. The signal conductors 10 have an undulating configuration woven along the length of the cable structure in which adjacent signal conductors are respectively one hundred and eighty degrees out of phase with each other. The warp yarns are all woven up and down together while the conductor wires are all woven up and down together and with the warp yarns to form a plain weave. The plain weave warp elements which consist of the warp yarns and warp ground conductors are woven at twice the frequency of the signal conductors as can best be seen in FIG. 2.

It will be noted that the signal conductors 10*b* and 10*e* directly opposed from each other, lie on opposite sides of the weft element. This is true of the corresponding warp conductor elements of the opposing strata of the cable which are opposed from each other for maximum separation.

Figure 4:
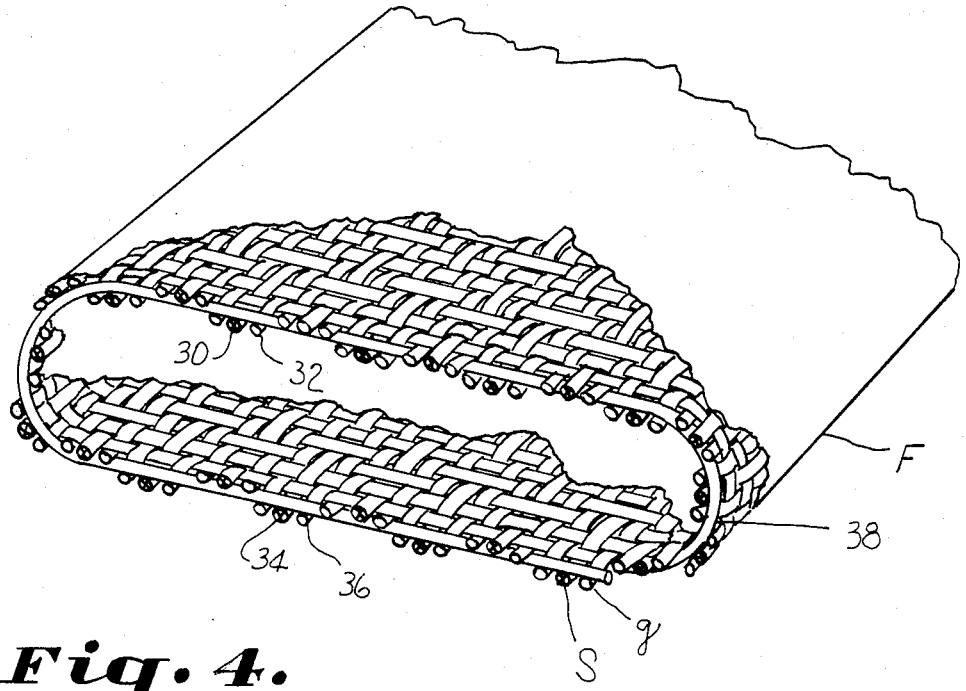
FIG. 4 is a partial perspective view of a tubular woven controlled impedance cable constructed according to the present invention with the construction being shown in detail with the warp yarns omitted in a tubular oval configuration.
Figure 5:
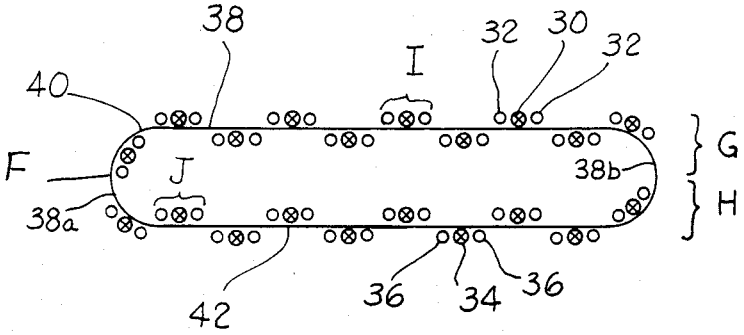
FIG. 5 is a schematic diagram illustrating a geometrical configuration of the conductor and ground wires of a tubular oval controlled impedance cable constructed in accordance with the present invention as taken along a section of FIG. 4.
Figure 6:
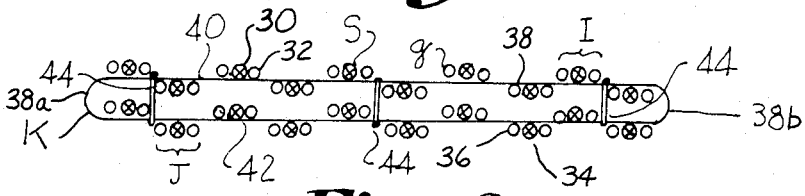
FIG. 6 is a schematic diagram of a section of a flat oval tubular woven control impedance cable constructed according to the present invention wherein the layers are generally parallel and bound together by ware binder elements.

In a preferred form of the invention, illustrated in FIGS. 4–6, a tubular woven controlled impedance cable F is woven in a generally oval configuration wherein a first layer G of warp elements and a second layer H of warp elements are arranged generally in parallel strata with respect to each other. The first layer G includes a plurality of conductors which includes signal conductors 30 and adjacent ground conductors 32 grouped to form clusters I. The lower second layer H includes a plurality of signal conductors 34 extending in the warp direction and adjacent ground wire pairs 36 on either side of the signal conductors extending in the warp direction which isolate the signal conductors from adjacent signal conductors and define a cluster J.

For purposes of clarity, only a portion of the detail of the tubular woven construction is illustrated in FIG. 4. The warp yarn elements omitted in the illustrations, it being understood that the warp yarns are woven as described in a plain weave with the ground conductor warp elements as described above.

A single weft element 38 is woven with the warp elements of the first and second layers to provide first and second cable structures 40 and 42. The weft provides rounded edges at 38*a* and 38*b* to an otherwise rectangular configuration. A continuously woven tubular fabric and cable is provided wherein the signal conductors are spaced laterally and vertically to effectively isolate the signal conductors from one another and provide a controlled impedance cable characteristic.

In FIG. 6, a woven tubular controlled impedance cable K is illustrated having a flattened oval configuration. Cable K has a construction like cable F illustrated in FIG. 5 except that the cable structures 40 and 42 are bound together by three warp binder elements 44 woven between the upper and lower strata or cable structures. Rounded edges are provided by weft 38 and all the clusters are preferably arranged and woven along the elongated rectangle edges as can best be seen in FIG. 6. An integral cable structure is had for routing and other purposes. The warp binder 44 may be woven over and under the weft element 38 of the first and second layers in a conventional manner.

Having been taught the above described cable constructions and method, the cable may be woven on a conventional shuttle or needle loom in accordance with known weaving techniques.

While a preferred embodiment of the invention has been described using specific terms, such description is for illustrative purposes only, and it is to be understood that changes and variations may be made without departing from the spirit or scope of the following claims.

What is claimed is:

1. A woven tubular controlled impedance electrical transmission cable comprising:

a number of warp elements which include a plurality of signal conductors for transmitting high-frequency electrical signals extending in a warp direction and a ground conductor extending in the warp direction on each side of each said signal conductor, each said signal conductor and ground conductors on the sides of the signal conductor defining a cluster of warp conductor elements whereby a plurality of said clusters are formed in said cable;

a continuous weft element woven with said warp elements to define a tubular woven cable having an open interior, said signal conductors being arranged around a periphery of said open interior of said cable so that a vertical component of spacing is provided between said signal conductors;

said ground wires isolating next adjacent signal wires from one another laterally while said vertical displacement isolates said signal conductors vertically from one another;

said signal conductors being woven with said weft element so as to have an undulating configuration woven along the length of said cable;

said vertically displaced signal conductors undulating with respect to each other to provide a non-parallel relationship between said signal conductors reducing signal interference therebetween; and said weft element being woven continuously through said clusters of warp conductors to provide continuously woven tubular woven fabric and cable around the entire periphery of said cable;

whereby said signal conductors are isolated laterally and vertically to effectively isolate said signal conductors from signal interference from one another and provide a controlled impedance cable characteristic.

2. The cable of claim 1 wherein said cable has an elongated tubular oval configuration, said clusters being arranged in two layers generally parallel with one another, and said weft element providing rounded edges connecting said layers.

3. The cable of claim 2 wherein said layers are bound together by binder means maintaining said layers and conductors therein in fixed proximity to one another.

4. A woven tubular controlled impedance electrical transmission cable comprising:

a first warp strata including a number of warp elements which include a plurality of signal conductors extending in a warp direction and a ground conductor extending in the warp direction on each side of each said signal conductor;

a second warp strata including a number of warp elements which include a plurality of signal conductors extending in the warp direction and a ground conductor extending in the warp direction on each side of said signal conductor;

said signal conductors of said first strata having a vertical displacement from said signal conductors of said second strata;

said ground wires isolating next adjacent signal wires from one another laterally while said vertical displacement isolates said signal conductors vertically from one another;

a weft element woven with said warp elements of said first strata to form an upper woven cable structure, said signal conductors of said first strata being woven with said weft element so as to have an undulating configuration woven along the length of said upper cable structure;

said weft element being woven with said warp elements of said second strata to form lower woven cable structure;

said signal conductors of said second strata being woven with said weft elements so as to have an undulating configuration along the length of said lower cable structure;

said vertically displaced signal conductors of each said strata undulating with respect to each other to provide a non-parallel relationship between said signal conductors of each said strata reducing signal interference therebetween; and said weft element being woven continuously through said upper and lower cable structures to provide continuously woven tubular woven fabric and cable around the entire periphery of said cable;

whereby said signal conductors are isolated laterally and vertically to effectively isolate said signal conductors from signal interference from one another and provide a controlled impedance cable characteristic.

5. The cable of claim 4 wherein said upper and lower cable structures are woven together in a tubular generally round configuration.

6. The cable of claim 4 wherein said upper and lower cable structures are woven together in a tubular generally oval configuration.

7. The cable of claim 6 wherein said upper and lower cable structures are bound together by means of a warp binder means physically interconnecting said first and second strata for flattening said oval cable producing a generally flat cable wherein said strata are generally formed as two parallel layers and said weft element is woven as rounded edges.

8. A method of weaving a controlled impedance electrical transmission cable to provide lateral and vertical displacement between signal conductors extending longitudinally in said cable comprising:

providing a plurality of warp elements including a number of warp conductor elements;

arranging said warp conductor elements in clusters, each said cluster including a signal conductor for transmitting high-frequency electrical signals and a ground conductor on each side of said signal conductor;

providing a weft element;

weaving said weft element with said warp elements to define a tubular woven cable having an open interior with said clusters arranged around a periphery of said open cable interior so that said arrangement about said periphery provides a vertical component of spacing between signal conductors of said clusters; and weaving said signal conductors with said weft element in an undulating manner so that corresponding signal conductors in opposing relation around said periphery have a non-parallel relation reducing noise producing fields therebetween preserving signal integrity.

* * * * *